US006644834B2

(12) United States Patent
Christen

(10) Patent No.: US 6,644,834 B2
(45) Date of Patent: Nov. 11, 2003

(54) PARTY LAMP

(75) Inventor: Louis J. Christen, Albuquerque, NM (US)

(73) Assignee: Louis J. Christen & Company, Inc., Albuquerque, NM (US)

( * ) Notice: Subject to any disclaimer, the term of this patent is extended or adjusted under 35 U.S.C. 154(b) by 0 days.

(21) Appl. No.: 10/139,075

(22) Filed: May 1, 2002

(65) Prior Publication Data

US 2003/0012025 A1 Jan. 16, 2003

Related U.S. Application Data

(60) Provisional application No. 60/305,945, filed on Jul. 16, 2001.

(51) Int. Cl.[7] ..... F21V 3/04

(52) U.S. Cl. ..... 362/311; 362/351; 362/363; 362/307; 362/311

(58) Field of Search ..... 362/351, 363, 362/307, 310, 311, 293, 362, 353, 355, 360, 361, 809, 343; D26/118, 119, 128, 135, 137

(56) References Cited

U.S. PATENT DOCUMENTS 2,271,836 A * 2/1942 Francis ..... 362/344
3,596,078 A * 7/1971 Owens ..... 362/184
4,434,455 A * 2/1984 Merritt ..... 362/307
6,227,683 B1 * 5/2001 Tukia ..... 362/303
6,491,415 B2 * 12/2002 Orellana ..... 362/375
2002/0085392 A1 * 7/2002 Hajianpour ..... 362/562

* cited by examiner

*Primary Examiner*—Sandra O'Shea
*Assistant Examiner*—Hargobind S. Sawhney
(74) *Attorney, Agent, or Firm*—Andrea L. Mays; Peacock, Myers & Adams, PC

(57) ABSTRACT

A portable lamp for providing mixed direct and diffused light. The lamp is especially suited for providing pleasant lighting conditions at a table or workbench. A hollow cover is mounted upon a base. A light bulb inside the cover provides light, the bulb being powered by a self contained power source such as a battery. The cover, which may be spherical, has a translucent upper portion for transmitting diffused light, a medial transparent portion for transmitting undiffused light directly to the tabletop, and an opaque lower portion. A conical shaped reflector within the cover serves to reflect light emitted by the bulb to the translucent and transparent portions of the cover. Colored translucent disks may be removably attached inside the cover to add color to the diffused light.

35 Claims, 3 Drawing Sheets

PARTY LAMP

CROSS-REFERENCE TO RELATED APPLICATIONS

This application claims the benefit of the filing of U.S. Provisional Patent Application Serial No. 60/305,945 entitled Party Light, filed on Jul. 16, 2001, and the specification thereof is incorporated herein by reference.

BACKGROUND OF THE INVENTION

1. Field of the Invention (Technical Field)

The present invention relates to the field of lighting sources and lamps, in particular to an electrical lamp to be placed on a table top or other surface for a combination of directed, diffused, and decorative lighting.

2. Background Art

Currently when dining at a table, picnicking, or gathering around a table surface for games, cards, and the like, candles, chandeliers, and other types of lighting fixtures are used to illuminate the area where persons are grouped. For dining, in particular, it is often desired that the lighting be controlled so that the illumination is conducive to viewing food and other persons sitting nearby, but not so overpowering as to inhibit the ambiance.

Each of the prior art lighting sources has limitations. Candles are messy, require igniting with a match or mechanical lighter, and are prone to having their flames being blown out inadvertently or dying out due to manufacturing defects in the candle. Overhead lighting is often not properly designed to light the surface adequately without directing light into the faces of the persons at the table. Many table lamps are not properly sized to be positioned on a dining room or picnic table and also do not provide the type of directional lighting that is appropriate for this setting. Further, these types of lighting sources require connection to an AC electrical power outlet with electrical cords. Most battery-powered lights, such as flashlights, are not appropriate for lighting a table setting. Fuel-burning lamps, such as kerosene lamps and the like, are also inappropriate for many settings.

On many occasions table settings further include flowers or a decorative object to be the focal points of the persons attending the dining occasion. Lighting and decor are both important at functions such as meals, parties, and games where persons are gathered around a table surface.

It would be useful to have a portable lighting source well-suited for a dining situation that provides directional lighting to the table surface without being overpowering or shining directly into the faces of the persons situated around the table area. Such a lighting source would ideally be powered from an isolated power source, such as batteries so that it could be readily transported to the location where lighting is required. The lighting source would be sized so as not to interfere with the limited surface area available on table surfaces. Ideally, the lighting source would provide directional lighting at the same time as diffused or translucent lighting to provide an appropriate ambiance. Finally, the lighting source would also serve a decorative purpose providing a focal point for the persons gathered around a table surface. Such a lighting source would eliminate the concern of providing appropriate lighting and decorative objects for every occasion.

Against the foregoing background, the present invention was developed.

SUMMARY OF THE INVENTION (DISCLOSURE OF THE INVENTION)

The apparatus of the invention is portable lamp for providing mixed direct and diffused light. The lamp is especially suited for providing pleasant lighting conditions at a table or workbench. A hollow cover is mounted upon a base. A light bulb inside the cover provides light, the bulb being powered by a self contained power source such as a battery. The cover, which may be spherical, has a translucent upper portion for transmitting diffused light, a medial transparent portion for transmitting undiffused light directly to the tabletop, and an opaque lower portion. A conical shaped reflector within the cover serves to reflect light emitted by the bulb to the translucent and transparent portions of the cover. Colored translucent disks may be removably attached inside the cover to add color to the diffused light.

According to one embodiment of the invention, there is provided a lamp apparatus for providing direct and diffused lighting, the lamp comprising a hollow globe substantially enclosing an interior space, the globe comprising an upper translucent portion, a medial transparent portion, and a lower opaque portion; a light bulb socket located within the interior space; and a reflector within the interior space and extending radially outward from the socket for directing light from the bulb toward the medial transparent portion. Preferably, the hollow cover is a substantially spherical globe. The base may be integrally molded with the lower opaque portion, while the upper translucent portion may be threadably engagable with the medial transparent portion. Preferably, the upper translucent portion comprises an upper hemisphere, the medial transparent portion comprises an equatorial band, and the lower opaque portion comprises a lower hemisphere. A power supply preferably is self-contained within the interior space.

A light bulb is removably insertable into each of the sockets, which bulb may be an incandescent bulb or a light emitting diode. The reflector preferably extends radially outward from the socket for directing light from the bulb toward the upper translucent portion and the medial transparent portion. A preferred embodiment of the inventive lamp also features a stem depending downward from an inside surface of the upper hemisphere, and at least one thin translucent disk removably attachable to the stem. When the translucent disk is attached to the stem, the perimeter of the at least one disk contacts the inside surface of the upper hemisphere. The at least one disk ideally is a plurality of interchangeable disks of differing colors.

A primary object of the present invention is to provide a lighting source that meets all of these needs as they are currently unmet by the prior art. A primary advantage of the present invention is that it readily accommodates table surfaces for dining or other occasions, providing appropriate lighting as well as serving a decorative function.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out.

BRIEF DESCRIPTION OF THE DRAWINGS

The accompanying drawings, which are incorporated into and form a part of the specification, illustrate an embodiment of the present invention and, together with the description, serve to explain the principles of the invention. The drawings are only for the purpose of illustrating a preferred embodiment of the invention and are not to be construed as limiting the invention. In the drawings.

Figure 1:
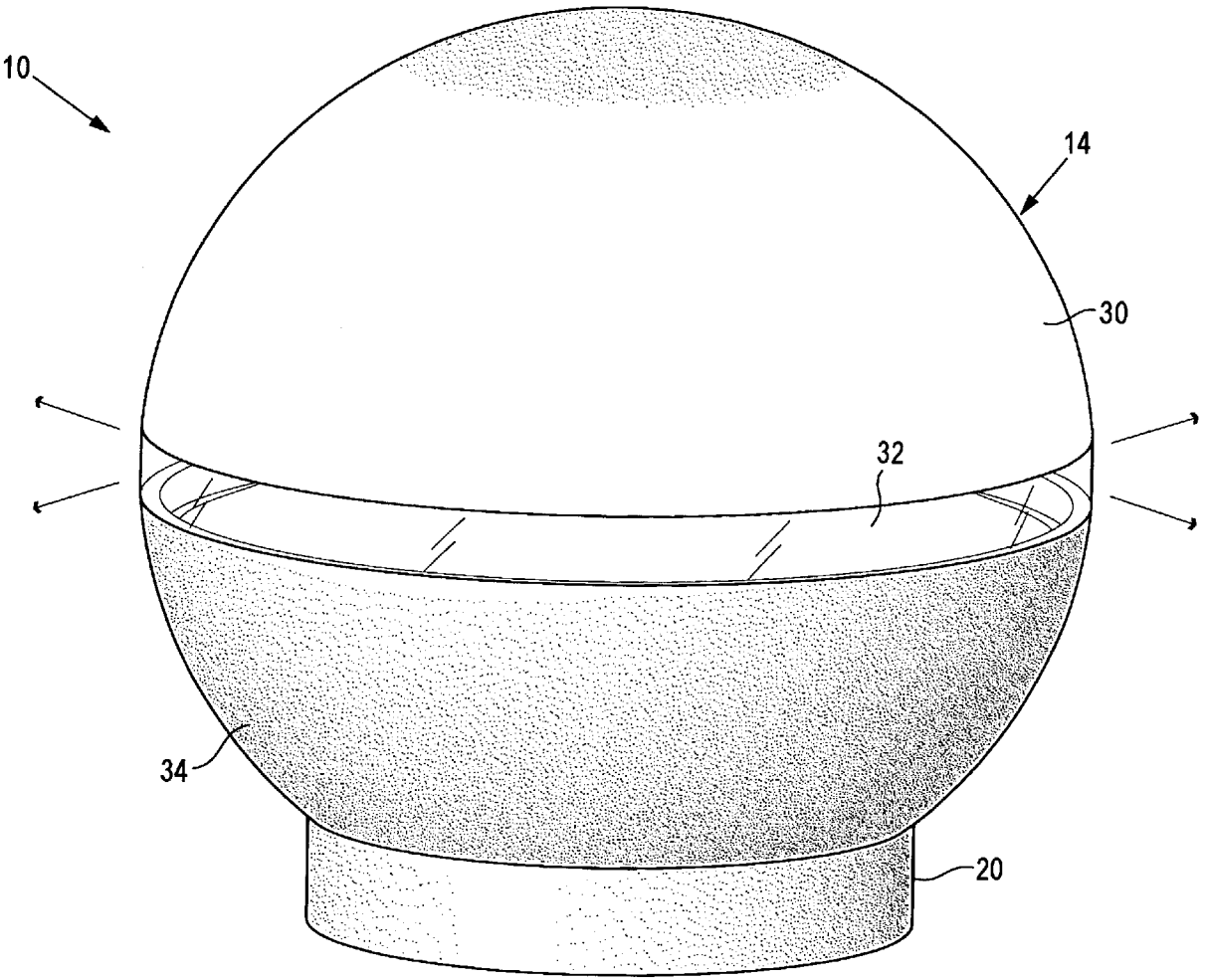
FIG. 1 is a perspective side view of one embodiment of the apparatus according to the present invention.

DESCRIPTION OF THE PREFERRED EMBODIMENTS (BEST MODES FOR CARRYING OUT THE INVENTION)

The present disclosure relates to an inventive table lamp that features the advantages of portability, simplicity, durability and, most advantageously, pleasant, effective lighting. Broadly characterized, the preferred embodiment of the inventive lamp is a generally spherical globe within which is mounted a small, incandescent light bulb. The globe has three distinct portions or regions with differing light transmission characteristics to diffuse and direct the light emitted by the bulb. The upper hemisphere of the globe is generally characterized as translucent; light is transmitted there through, but highly diffused upon transmission. An equatorial band portion of the globe is generally transparent, and functions as a lens to transmit light from the interior bulb radially outward for direct lighting purposes. The lower hemisphere of the globe preferably is generally opaque to incandescent light.

Preferably, the inventive lamp is entirely self-contained, with an on-board battery pack as the energy source. Conventional switching circuitry delivers electricity from the battery to the bulb, and permits the lamp to be turned on and off. An annular reflector is mounted interior to the globe to promote passage of light radially outward through the transparent equatorial lens.

The invention is readily understood with collective reference to the drawing figures. Referring collectively to the drawings, it is seen that the invention broadly described, is a lamp apparatus 10 including a hollow cover 14 defining an interior space 24. The cover 14 has an upper translucent portion 30, a medial transparent portion 32, and a lower substantially opaque portion 34. Some means, such as a typical friction or clip socket, is provided for mounting a light bulb 16 centrally within the interior space 24. The complete cover 14 rests in or is connected to a supporting base 20 which may have a circular footprint. A reflector 40 is disposed within the interior space 24 for directing light from the bulb 16 toward the medial transparent portion 32.

More narrowly described, the preferred embodiment of the lamp 10 is for providing direct and diffused lighting, and features a cover 14 that is a substantially spherical globe. The globular cover 14 at least partially surrounds the interior space 24. The upper translucent portion 30 of the globe 14 is a translucent hemisphere. The medial transparent portion 32 is a transparent equatorial band or lens, and the lower opaque portion 34 is a hemisphere. The light bulb socket 17 is located centrally within the interior space 24. In the preferred embodiment, the reflector 40 is a substantially frusto-conical reflector, with the socket 17 located at the apex of the imaginary cone containing the frusto-conical reflector 40; in such an embodiment, the reflector 40 extends at least partially from the upper edge of the opaque lower hemisphere 34 toward the socket 17.

Figure 2:
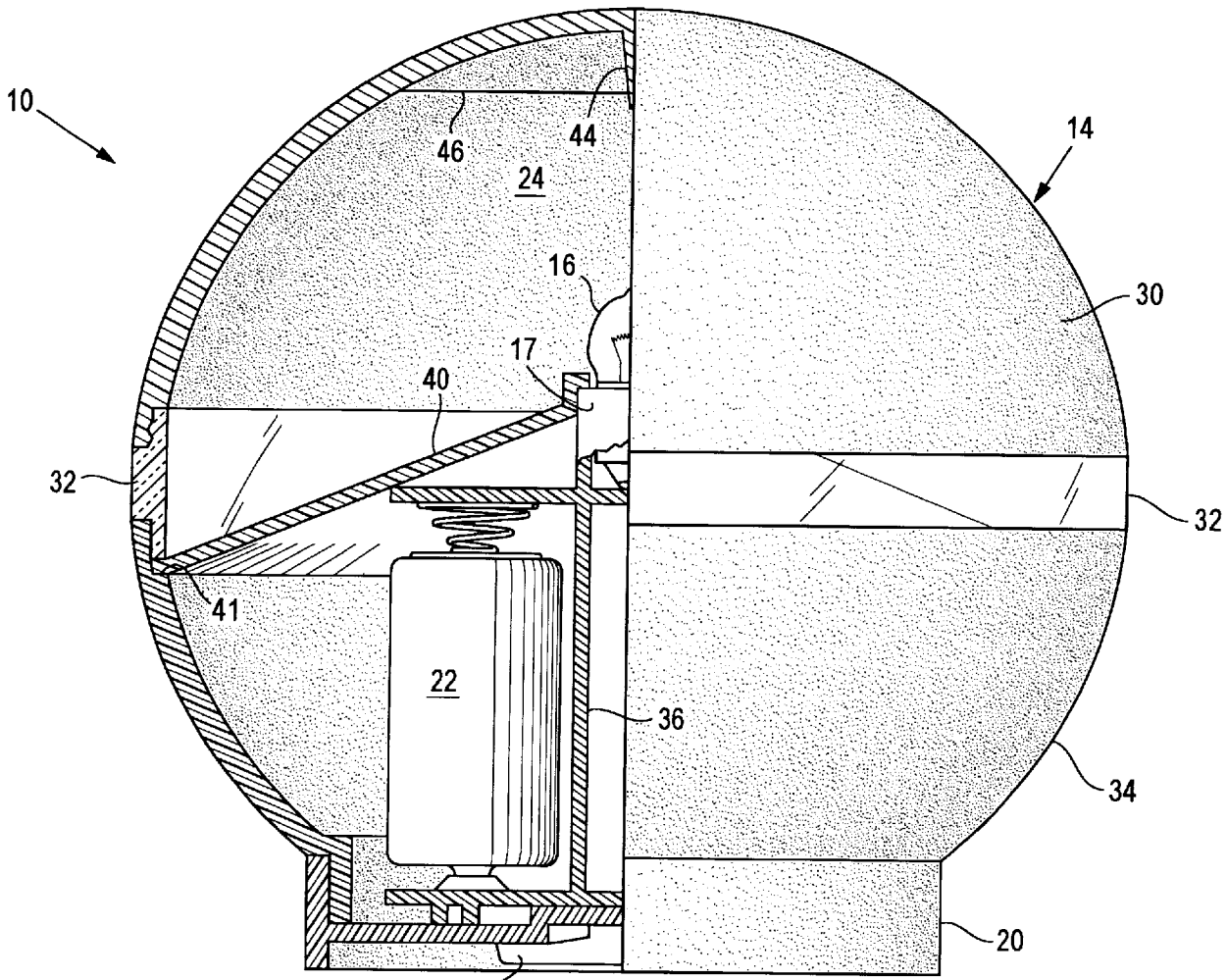
FIG. 2 is a side view of the embodiment seen in FIG. 1, with a portion cut-out to reveal certain interior components.

Attention is now invited to FIGS. 1 and 2 for added detail. The lamp 10 includes an exterior cover 14 and a base 20. The principal components of the lamp 10 may be molded from durable lightweight plastics known in the lighting arts. The cover 14 preferably is a globe having an approximately spherical shape. The generally spherical shape of the cover 14 promotes symmetrical illumination from at least one light bulb 16 located within the interior space 24 defined by the cover 14. While the preferred shape of the cover 14 is that of a generally spherical globe, it will be understood that covers having other shapes are within the scope of the invention, most especially any cover 14 having a circular or elliptical horizontal section, such as vertical cylinders, oblate sheroids, parabolic sheroids, or the like. The globular cover 14 preferably has a vertical dimension slightly less than its horizontal dimension, aesthetically to subdue the spherical shape.

The cover 14 has three separate portions or zones, which may be mutually integral but preferably are separately manufactured and then assembled. The functional portions are an upper translucent portion 30, a medial transparent portion 32, and a lower opaque portion 34. The base 20 preferably is integrally molded into and with the lower opaque portion 34, or may be separably attached.

Circumferential, directional illumination is provided from an approximately equatorial location on the spherical cover 14 through the transparent medial portion 32, which preferably is a clear plastic or glass band or lens. The upper translucent portion 30 preferably is fashioned from white translucent plastic, or from frosted glass or other equivalent material to allow diffused light to pass there through. The lower portion 34 base preferably is opaque, or negligibly translucent, to allow little or no light to pass through. The lower portion 34 rests in or is permanently connected to the base 20 for stable placement onto a tabletop or other horizontal surface.

Figure 3:
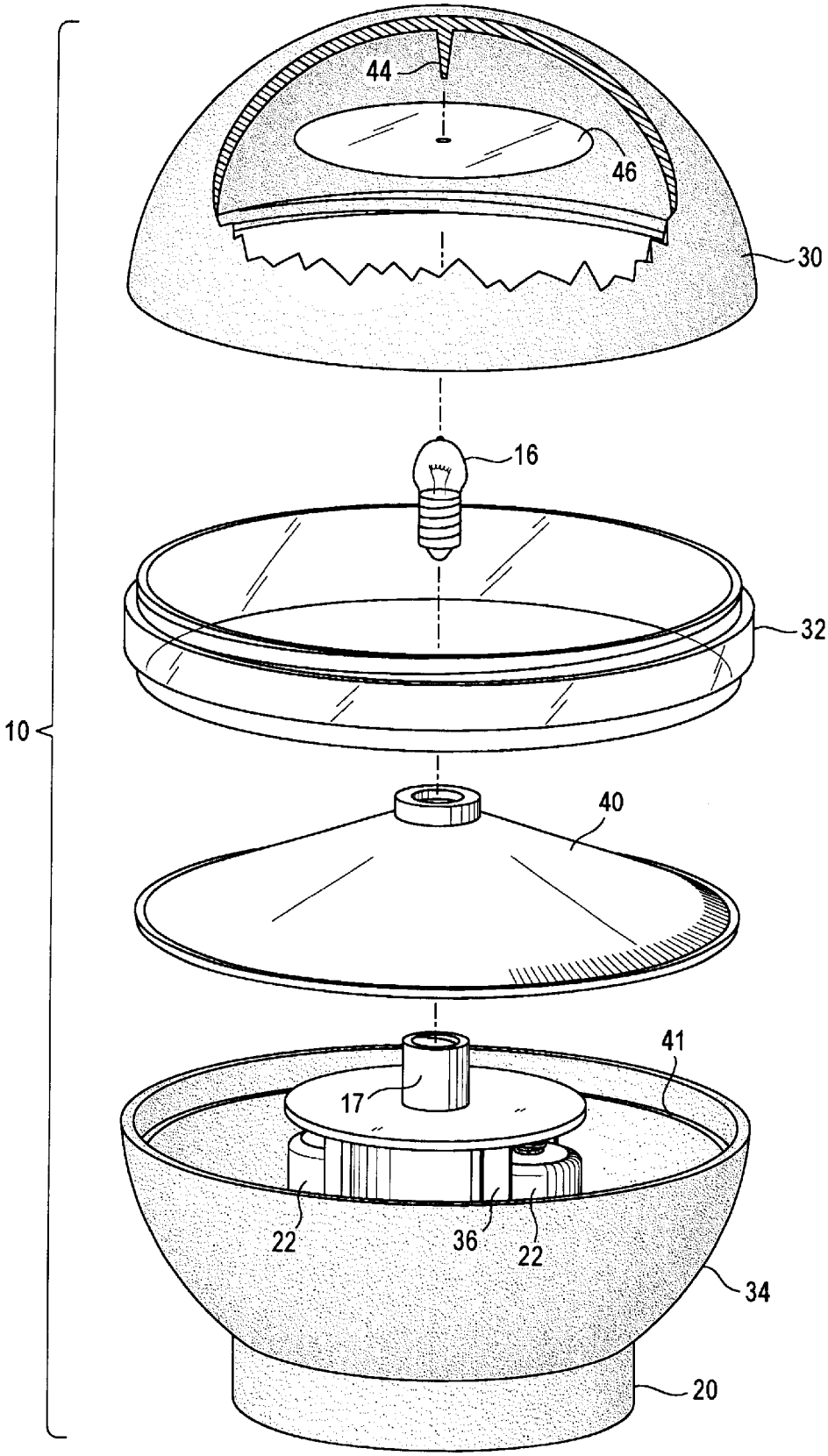
FIG. 3 is an exploded perspective view of the embodiment shown in FIG. 2, with portions cut away to expose certain interior features.

Reference is made to FIGS. 2 and 3. Within the interior space 24 defined, and preferably substantially enclosed by, the cover 14 is disposed an isolated power supply 22. Alternatively, a power supply may be disposed within the base 20. The power supply 22 may be, for example, four disposable or rechargeable D-cell batteries or the like, which provide electrical energy, through conventional wiring and circuitry, for powering at least one light bulb 16. The bulb 16 is removably inserted in a corresponding standard bulb socket 17, so as to be replaceable when burned out. The socket 17 preferably is located at about the three-dimensional center of the interior space, preferably on or just above the "equatorial plane" of the spherical cover 14. The light bulb 16 can be one of a variety of types of bulbs of different shapes, sizes, and wattage, but preferably is a conventional low-wattage flashlight-type bulb.

Preferably, the bulb 16 is incandescent, but the invention is not so limited, and alternative light sources such one or more light-emitting diodes may be used. Further, while the preferred embodiment of the lamp 10 is portable and cordless, it is readily apparent that the lamp alternatively may be powered through a conventional electrical cord connected to a standard alternating current source. The power supply 22, bulb socket 17, and associated wiring are secured to and supported by an interior frame 36, such that the batteries can provide electrical current to the bulb 16. A switch 38 is provided, preferably hidden from view but accessible beneath the base 20. Switch 17 can toggle in the usual manner to allow the user to turn the bulb 16 (and thus the lamp 10) off and on by breaking or closing the circuit between the power supply 22 and light bulb 16.

A reflector 40 extends radially outward and at a downward angle, approximately 45 degrees, from the socket 17.

Reflector 40 preferably has a frusto-conical shape, with the socket 17 located at the apex of the imaginary cone containing the reflector, and the reflector extending at least partially from the upper edge of the opaque lower hemisphere 34 toward the socket 17. In the preferred embodiment, the reflector 40 extends the complete distance from the socket 17 to the cover 14. In alternative embodiments, the reflector may have an abbreviated radial dimension; it thus may extend outward from the socket 17 only part of the distance to the cover 14, or alternatively only part of the distance from the upper edge of the lower portion 34 of the cover upward and inward toward the socket 17 (a gap separating the inner perimeter of the reflector from the socket). At least the upper surface of the reflector 40 has a shiny, mirrored finish to maximize the reflection of light.

As mentioned, in the preferred embodiment, the reflector 40 extends completely from the socket 17 to the upper circumferential edge of the lower opaque portion 34, where the lower outside rim of the reflector rests on a radially inwardly-directed ledge 41 or groove provided around the entire inner circumference of the opaque lower portion 34, as depicted in FIG. 2. Alternatively, the ledge 41 may instead be a plurality of segmental, arcuate, ledges arrayed around the circumference of the lower portion 34.

A clear transparent or slightly translucent band or "lens" portion 32 allows light emitted from the bulb 16 to pass from the interior of the lamp 10 to the surrounding environment. The lens portion 32 fits between the opaque lower portion 34 and the translucent upper portion 30 of the apparatus. The transparent medial portion 32 may be simply an annular band, or in elaborate alternative embodiments may be crafted into a rudimentary lens for collecting and directing the light emitted by the bulb 16 and reflected from the reflector 40. The index of refraction and focal point of such a lens portion can be of a variety of values and locations as a design for a particular application may require.

All three cover elements, 30, 32, and 34, preferably have approximately the same radius of curvature, particularly in the "equatorial" area of the cover 14 so that in an assembled cover they come into mutual registration to provide an aesthetically smooth exterior contour for the complete cover 14. As suggested in FIG. 2, the lower edge of the medial transparent portion 32, band, or "lens" can interlock with the upper edge of the lower opaque portion 34, and may be permanently adhered thereto. In a preferred embodiment, the lower edge area of the upper translucent portion 30 and the upper edge area of the medial transparent portion 32 are both provided with screw threads, so that the upper portion 30 can be removably attached by screwed engagement with the medial portion 32. Threaded engagement of the upper portion 30 with the medial portion 32 permits the upper portion to be "screwed" off and removed to allow access to the reflector 40, and especially to the bulb 16 when the bulb needs replacement.

Reference is made to FIG. 2. Optionally but preferably, a thin, tapered, rigid stem 44 extends vertically downward from the uppermost point or "zenith" of the inside of the upper translucent hemisphere 30. There is provided at least one colored, translucent, thin, plastic disk 46 or round, colored, film. Preferably, in commercial embodiments of the lamp 10, there are provided a plurality of film disks 46 of differing colors, and/or of any visually-interesting pattern, and/or design or copy (such as an advertising logo). Each thin disk 46 has a small hole at its center. The tapered stem 44 is insertable into the central hole of particular selected thin disk 46 until the disk is frictionally retained upon the stem 44 (or snaps over a ridge or detent provided on the stem), the disk 46 therefore to hang from the stem within the interior space 24 when the lamp is in use.

Preferably, each thin disk 46 is sized with a selected diameter so that when removably installed upon the stem 44, the disk 46 is situated horizontally with its circumferential perimeter smartly in contact with the upper inside surface of the upper translucent hemisphere 30. Light passing through the disk 46 and subsequently through the frosted upper portion 30 provides a colorful "glow" at the top of the party lamp 10, or creates a viewable pattern or copy (such as an advertising logo) upon the portion 30. Most preferably, a plurality of interchangeable disks 46 of various colors and/or patterns are provided with each party lamp 10, so that the user can select a particular color or pattern for use on a given occasion. The user can decorate a table as desired, or can decorate several tables with lights of the same or complementary different colors or patterns.

When the lamp 10 is in use, light from the bulb 16 is emitted initially onto four surfaces where it is reflected, refracted, or transmitted depending upon the index of refraction and other characteristics of the surface, as will be appreciated by those skilled in the art. Some of the light passes directly through the lens portion 32 and is emitted with little or no diffusion, the light being directed according to the optical design of the lens 32. Some of the light is reflected from the reflector 40 and subsequently emitted out the lens portion 32 and/or the frosted or translucent upper portion 30. Some light will be emitted from the bulb 16 and thence through the translucent upper portion or hemisphere 30. Light will also pass through the colored disk 46, if used, located at the top of the cover 14 and out of the translucent upper portion 30 providing a color "glow" to the top of the party lamp 10 as suggested in FIG. 1.

This design provides illumination that is decorative, diffused, and directional all at the same time. The light emitting from the medial, or equatorial lens portion 32 lights the food or other objects at the table surface level at an appropriate lighting level and direction, but does not directly overpower or glare into the faces of persons sitting around the table. The translucent portion 30 and colored disk 46 provide additional, diffused light and decorative focal points for persons situated around the lamp 10. The lamp 10 can be used for a variety of lighting needs other than dining, including reading, lighting a walkway, or a work-surface.

It will be appreciated that a variety of materials having a variety of optical characteristics can be used to practice the inventive principles of the present invention for a lamp 10. Furthermore, the present invention can take on many forms beyond that depicted in the figures. The transparent, translucent, opaque and colored portions of the lamp can of course be arranged in different configurations to produce the desired lighting and decorative effect. Furthermore, components of the lamp can be altered to produce the desired lighting effect, such as the location of the light bulb 16, the angle of the reflector 40, the optical characteristics of the medial band or lens portion 32, and the proportions of the opaque, lens, frosted, and colored portions of the party lamp.

The assembled cover 14 preferably is between about 5 inches and about 7 inches, and most preferably approximately 6.25 inches, in outside diameter; however these dimensions are offered by way of example rather than limitation. In an assembled cover 14 having a diameter of about 6.25 inches, the medial transparent portion 32, lens or band is about 0.5 inches high. Again by way of example, the base 20 may be about 0.625 inches high and have a circular footprint of about 3.75 inches in diameter.

Further, the base 20 may be provided with a small access hatch or door, according to any of various types or modes, to permit access to the interior of the cover 14 below the reflector, and access to the interior of the base 20, for example to permit the batteries of the power supply 22 to be removed for recharge or replacement.

Although the invention has been described in detail with particular reference to this preferred embodiment, other embodiments can achieve the same results. Variations and modifications of the present invention will be obvious to those skilled in the art and the invention is intended to cover all such modifications and equivalents. The entire disclosures of all references, applications, patents, and publications cited above are hereby incorporated by reference.

What is claimed is:

1. A lamp apparatus comprising:

a hollow cover defining an interior space, said cover comprising an upper translucent portion, a medial transparent portion, and a lower substantially opaque portion;

means for mounting a light bulb centrally within said interior space; and a reflector disposed within said interior space for directing light from said bulb toward said medial transparent portion.

2. An apparatus according to claim 1 wherein said cover comprises an upper translucent portion, a medial transparent portion, and a lower opaque portion.

3. An apparatus according to claim 2, wherein said hollow cover is a substantially spherical globe.

4. An apparatus according to claim 2 further comprising a base connected to said lower opaque portion.

5. An apparatus according to claim 2 wherein said upper translucent portion is threadably engagable with said medial transparent portion.

6. An apparatus according to claim 3 wherein said upper translucent portion comprises an upper hemisphere, said medial transparent portion comprises an equatorial band, and said lower opaque portion comprises a lower hemisphere.

7. An apparatus according to claim 1 further comprising a power supply self-contained within said interior space.

8. An apparatus according to claim 1 wherein said means for mounting comprises at least one electrical socket, and further comprising a light bulb removably insertable into each said socket.

9. An apparatus according to claim 8 wherein said light bulb is selected from the group consisting of incandescent bulbs and light emitting diodes.

10. An apparatus according to claim 8 wherein said reflector extends radially outward from said socket for directing light from said bulb toward said medial transparent portion.

11. An apparatus according to claim 6 further comprising:

a stem depending downward from an inside surface of said upper hemisphere; and at least one thin translucent disk removably attachable to said stem.

12. An apparatus according to claim 11 wherein when said translucent disk is attached to said stem, the perimeter of said at least one disk contacts said inside surface of said upper hemisphere.

13. An apparatus according to claim 12, wherein said at least one disk comprises a plurality of interchangeable disks of differing colors.

14. A lamp apparatus for providing direct and diffused lighting, said lamp comprising:

a hollow globe substantially enclosing an interior space, said globe comprising an upper translucent portion, a medial transparent portion, and a lower opaque portion;

a light bulb socket located within said interior space; and a reflector within said interior space and extending radially outward from said socket for directing light from said bulb toward said medial transparent portion.

15. An apparatus according to claim 14, wherein said hollow cover is a substantially spherical globe.

16. An apparatus according to claim 14 further comprising a base integrally molded with said lower opaque portion.

17. An apparatus according to claim 14 wherein said upper translucent portion is threadably engagable with said medial transparent portion.

18. An apparatus according to claim 15 wherein said upper translucent portion comprises an upper hemisphere, said medial transparent portion comprises an equatorial band, and said lower opaque portion comprises a lower hemisphere.

19. An apparatus according to claim 14 further comprising a power supply self-contained within said interior space.

20. An apparatus according to claim 14 further comprising a light bulb removably insertable into each said socket.

21. An apparatus according to claim 20 wherein said light bulb is selected from the group consisting of incandescent bulbs and light emitting diodes.

22. An apparatus according to claim 20 wherein said reflector extends radially outward from said socket for directing light from said bulb toward said upper translucent portion and said medial transparent portion.

23. An apparatus according to claim 18 further comprising:

a stem depending downward from an inside surface of said upper hemisphere; and at least one thin translucent disk removably attachable to said stem.

24. An apparatus according to claim 23 wherein when said translucent disk is attached to said stem, the perimeter of said at least one disk contacts said inside surface of said upper hemisphere.

25. An apparatus according to claim 23, wherein said at least one disk comprises a plurality of interchangeable disks of differing colors.

26. A lamp apparatus for providing direct and diffused lighting, said lamp comprising:

a cover comprising a substantially spherical globe at least partially surrounding an interior space, said globe comprising an translucent upper hemisphere, an transparent equatorial band, and an opaque lower hemisphere;

at least one light bulb socket located centrally within said interior space; and a substantially frusto-conical reflector within said interior space, said socket located at the apex of the imaginary cone containing said frusto-conical reflector, and said reflector extending radially inward at least partially from the upper edge of said opaque lower hemisphere toward said socket.

27. An apparatus according to claim 26 further comprising a base integrally molded with said opaque lower hemisphere.

28. An apparatus according to claim 26 wherein said translucent upper hemisphere is threadably engagable with said transparent equatorial band.

29. An apparatus according to claim 26 wherein said transparent equatorial band comprises an annular clear lens.

30. An apparatus according to claim 29 further comprising a light bulb removably insertable into each said socket.

31. An apparatus according to claim 30 wherein said light bulb is selected from the group consisting of incandescent bulbs and light emitting diodes.

32. An apparatus according to claim 31 wherein said reflector reflects light from said bulb toward said upper translucent portion and said medial transparent portion.

33. An apparatus according to claim 32 further comprising:

a stem depending downward from an inside surface of said upper hemisphere; and at least one thin translucent disk removably attachable to said stem.

34. An apparatus according to claim 33 wherein when said translucent disk is attached to said stem, the perimeter of said at least one disk contacts said inside surface of said upper hemisphere.

35. An apparatus according to claim 34, wherein said at least one disk comprises a plurality of interchangeable disks of differing colors.

* * * * *